US010344351B2

(12) United States Patent
Hayashi et al.

(10) Patent No.: US 10,344,351 B2
(45) Date of Patent: Jul. 9, 2019

(54) HOT-PRESSED STEEL SHEET MEMBER, METHOD OF MANUFACTURING THE SAME, AND STEEL SHEET FOR HOT PRESSING

(71) Applicant: NIPPON STEEL & SUMITOMO METAL CORPORATION, Tokyo (JP)

(72) Inventors: Koutarou Hayashi, Tokyo (JP); Toshinobu Nishibata, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 351 days.

(21) Appl. No.: 15/104,689

(22) PCT Filed: Dec. 20, 2013

(86) PCT No.: PCT/JP2013/084333
§ 371 (c)(1),
(2) Date: Jun. 15, 2016

(87) PCT Pub. No.: WO2015/092929
PCT Pub. Date: Jun. 25, 2015

(65) Prior Publication Data

US 2016/0312330 A1 Oct. 27, 2016

(51) Int. Cl.
*C22C 38/02* (2006.01)
*C22C 38/04* (2006.01)
(Continued)

(52) U.S. Cl.
CPC ..... *C21D 9/46* (2013.01); *C21D 1/18* (2013.01); *C21D 7/13* (2013.01); *C21D 8/0247* (2013.01);
(Continued)

(58) Field of Classification Search
None
See application file for complete search history.

(56) References Cited

U.S. PATENT DOCUMENTS

2009/0202383 A1 8/2009 Tanaka et al.
2010/0139821 A1 6/2010 Giefers et al.
(Continued)

FOREIGN PATENT DOCUMENTS

CA 2923585 A1 3/2015
CA 2924812 A1 3/2015
(Continued)

OTHER PUBLICATIONS

Machine-English translation of JP 2011-214070, Imai Norio et al., Oct. 27, 2011.*
(Continued)

*Primary Examiner* — Colin W. Slifka
(74) *Attorney, Agent, or Firm* — Birch, Stewart, Kolasch & Birch, LLP

(57) ABSTRACT

A hot-pressed steel sheet member includes: a specific chemical composition; and a steel microstructure represented by, in area %, ferrite: 10% to 70%, martensite: 30% to 90%, and a total area ratio of ferrite and martensite: 90% to 100%. 90% or more of all Ti in steel precipitates, and a tensile strength of the hot-pressed steel sheet member is 980 MPa or more.

6 Claims, 1 Drawing Sheet

(51) Int. Cl.

| | |
|---|---|
| ***C22C 38/06*** | (2006.01) |
| ***C22C 38/14*** | (2006.01) |
| ***C21D 6/02*** | (2006.01) |
| ***C21D 8/02*** | (2006.01) |
| ***C21D 8/04*** | (2006.01) |
| ***C21D 9/46*** | (2006.01) |
| ***C21D 9/48*** | (2006.01) |
| ***C21D 1/18*** | (2006.01) |
| ***C22C 38/58*** | (2006.01) |
| ***C22C 38/00*** | (2006.01) |
| ***C22C 38/12*** | (2006.01) |
| ***C21D 7/13*** | (2006.01) |
| ***C22C 38/08*** | (2006.01) |
| ***C22C 38/16*** | (2006.01) |
| ***C22C 38/28*** | (2006.01) |
| *B21D 22/02* | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/58* (2013.01); *B21D 22/022* (2013.01); *C21D 2211/004* (2013.01); *C21D 2211/005* (2013.01); *C21D 2211/008* (2013.01)

(56) References Cited

U.S. PATENT DOCUMENTS

| | | | | |
|---|---|---|---|---|
| 2010/0221572 | A1 | 9/2010 | Laurent et al. | |
| 2011/0042625 | A1 | 2/2011 | Tanaka et al. | |
| 2014/0216612 | A1 | 8/2014 | Laurent et al. | |
| 2015/0007911 | A1* | 1/2015 | Murakami ..... | C22C 38/00 148/507 |
| 2015/0017471 | A1 | 1/2015 | Shuto et al. | |

FOREIGN PATENT DOCUMENTS

| | | | |
|---|---|---|---|
| CA | 2934597 | A1 | 7/2015 |
| CA | 2934599 | A1 | 7/2015 |
| CN | 101218362 | A | 7/2008 |
| CN | 102282280 | A | 12/2011 |
| CN | 102031456 | B | 7/2013 |
| EP | 2371978 | A1 | 10/2011 |
| EP | 2 612 945 | A1 | 7/2013 |
| GB | 1 490 535 | A | 11/1977 |
| JP | 10-96031 | A | 4/1998 |
| JP | 10-195591 | A | 7/1998 |
| JP | 10-280050 | A | 10/1998 |
| JP | 2007-16296 | A | 1/2007 |
| JP | 2009-35793 | A | 2/2009 |
| JP | 2009-197253 | A | 9/2009 |
| JP | 2010-43323 | A | 2/2010 |
| JP | 2010-65292 | A | 3/2010 |
| JP | 2010-65293 | A | 3/2010 |
| JP | 2010-131672 | A | 6/2010 |
| JP | 2010-521584 | A | 6/2010 |
| JP | 2010-174276 | A | 8/2010 |
| JP | 2011-99149 | A | 5/2011 |
| JP | 2013-184218 | A | 9/2013 |
| JP | 2013-185248 | A | 9/2013 |
| JP | 2014-5521 | A | 1/2014 |
| TW | 201226582 | A1 | 7/2012 |
| TW | 201335383 | A1 | 9/2013 |
| WO | WO 20113/133164 | A1 | 9/2013 |

OTHER PUBLICATIONS

Machine-English translation of JP2007-016296, Azuma Masashi et al., Jan. 25, 2007.*

Extended European Search Report dated Jul. 17, 2017 in European Patent Application No. 13899869.5.

International Search Report for PCT/JP2013/084333 dated Apr. 8, 2014.

Written Opinion of the International Searching Authority for PCT/JP2013/084333 (PCT/ISA/237) dated Apr. 8, 2014.

International Preliminary Report on Patentability and English translation of the Written Opinion of the International Searching Authority (Forms PCT/IB/338, PCT/IB/373 and PCT/ISA/237), dated Jun. 30, 2016, for International Application No. PCT/JP2013/084333.

Canadian Office Action issued in Canadian Application No. 2,933,435, dated Apr. 21, 2017.

Korean Office Action issued in Korean Application No. 10-2016-7015363, dated Apr. 14, 2017, together with an English translation.

Chinese Office Action and Search Report issued in Chinese Application No. 201380081757.1 dated Mar. 1, 2017.

Brazilian Office Action issued in Brazilian Patent Application No. BR112016014036-2 dated Mar. 21, 2019.

* cited by examiner

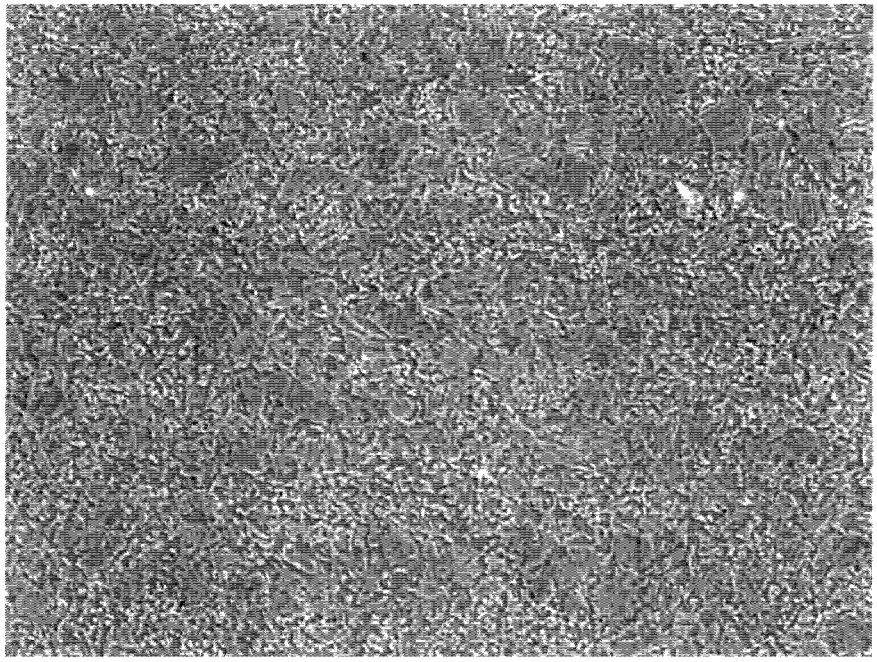

HOT-PRESSED STEEL SHEET MEMBER, METHOD OF MANUFACTURING THE SAME, AND STEEL SHEET FOR HOT PRESSING

TECHNICAL FIELD

The present invention relates to a hot-pressed steel sheet member used for a mechanical structural component and the like, a method of manufacturing the same, and a steel sheet for hot pressing.

BACKGROUND ART

For reduction in weight of an automobile, efforts are advanced to increase the strength of a steel material used for an automobile body and to reduce the weight of steel material used. In a thin steel sheet widely used for the automobile, press formability thereof generally decreases with an increase in strength, thus making it difficult to manufacture a component having a complicated shape. For example, a highly processed portion fractures with a decrease in ductility, and springback becomes prominent to deteriorate dimensional accuracy. Accordingly, it is difficult to manufacture components by performing press-forming on a high-strength steel sheet, in particular, a steel sheet having a tensile strength of 980 MPa or more. It is easy to process the high-strength steel sheet not by press-forming but by roll-forming, but its application target is limited to a component having a uniform cross section in a longitudinal direction.

Methods called hot pressing intended to obtain high formability in the high-strength steel sheet are described in Patent Literatures 1 to 4. By the hot pressing, it is possible to form the high-strength steel sheet with high accuracy to obtain a high-strength hot-pressed steel sheet member.

On the other hand, the hot-pressed steel sheet member is required to be improved also in ductility. However, steel microstructure of the steel sheet obtained by the methods described in Patent Literatures 1 to 4 is substantially a martensite single phase, and thus it is difficult for the methods to improve in ductility.

Hot-pressed steel sheet members intended to improve in ductility are described in Patent Literatures 5 to 7, but it is also difficult for these conventional hot-pressed steel sheet members to balance strength and ductility.

A hot-pressed steel sheet member intended to improve in ductility is described also in Patent Literature 8. However, manufacture of the hot-pressed steel sheet member requires complicated control and thus has other problems such as decrease in productivity and increase in manufacturing cost.

CITATION LIST

Patent Literature

Patent Literature 1: U.K. Patent No. 1490535

Patent Literature 2: Japanese Laid-open Patent Publication No. 10-96031

Patent Literature 3: Japanese Laid-open Patent Publication No. 2009-197253

Patent Literature 4: Japanese Laid-open Patent Publication No. 2009-35793

Patent Literature 5: Japanese Laid-open Patent Publication No. 2010-65292

Patent Literature 6: Japanese Laid-open Patent Publication No. 2010-65293

Patent Literature 7: Japanese Translation of PCT International Application Publication No. 2010-521584

Patent Literature 8: Japanese Laid-open Patent Publication No. 2010-131672

SUMMARY OF INVENTION

Technical Problem

An object of the present invention is to provide a hot-pressed steel sheet member capable of obtaining excellent strength and ductility without performing complicated control, a method of manufacturing the same, and a steel sheet for hot pressing.

Solution to Problem

As a result of earnest studies to solve the above problems, the inventors of the present application have found that a hot-pressed steel sheet member having a steel microstructure being a multi-phase microstructure containing ferrite and martensite can be obtained without performing complicated control as described in Patent Literature 8, by treating a steel sheet for hot pressing having a chemical composition containing specific amounts of C and Mn and relatively large amount of Ti, and having a specific steel microstructure including hot pressing under specific conditions. The inventors of the present application have also found that the hot-pressed steel sheet member has a high tensile strength of 980 MPa or more and excellent ductility. The inventors of the present application have reached various aspects of the invention described below.

(1)

A hot-pressed steel sheet member, including:

a chemical composition represented by, in mass %:

C: 0.10% to 0.24%;

Si: 0.001% to 2.0%;

Mn: 1.2% to 2.3%;

sol. Al: 0.001% to 1.0%;

Ti: 0.060% to 0.20%;

P: 0.05% or less;

S: 0.01% or less;

N: 0.01% or less;

Nb: 0% to 0.20%;

V: 0% to 0.20%;

Cr: 0% to 1.0%;

Mo: 0% to 0.15%;

Cu: 0% to 1.0%;

Ni: 0% to 1.0%;

Ca: 0% to 0.01%;

Mg: 0% to 0.01%;

REM: 0% to 0.01%;

Zr: 0% to 0.01%;

B: 0% to 0.005%;

Bi: 0% to 0.01%; and balance: Fe and impurities; and a steel microstructure represented by, in area %:

ferrite: 10% to 70%;

martensite: 30% to 90%; and a total area ratio of ferrite and martensite: 90% to 100%, wherein 90% or more of all Ti in steel precipitates, and wherein a tensile strength of the hot-pressed steel sheet member is 980 MPa or more.

(2)

The hot-pressed steel sheet member according to (1), wherein the chemical composition contains one or more selected from the group consisting of, in mass %:

Nb: 0.003% to 0.20%;
V: 0.003% to 0.20%;
Cr: 0.005% to 1.0%;
Mo: 0.005% to 0.15%;
Cu: 0.005% to 1.0%; and
Ni: 0.005% to 1.0%.

(3)

The hot-pressed steel sheet member according to (1) or (2), wherein the chemical composition contains one or more selected from the group consisting of, in mass %:
Ca: 0.0003% to 0.01%;
Mg: 0.0003% to 0.01%;
REM: 0.0003% to 0.01%; and
Zr: 0.0003% to 0.01%.

(4)

The hot-pressed steel sheet member according to any one of (1) to (3), wherein the chemical composition contains, in mass %, B: 0.0003% to 0.005%.

(5)

The hot-pressed steel sheet member according to any one of (1) to (4), wherein the chemical composition contains, in mass %, Bi: 0.0003% to 0.01%.

(6)

A steel sheet for hot pressing, including:
a chemical composition represented by, in mass %:
C: 0.10% to 0.24%;
Si: 0.001% to 2.0%;
Mn: 1.2% to 2.3%;
sol. Al: 0.001% to 1.0%;
Ti: 0.060% to 0.20%;
P: 0.05% or less;
S: 0.01% or less;
N: 0.01% or less;
Nb: 0% to 0.20%;
V: 0% to 0.20%;
Cr: 0% to 1.0%;
Mo: 0% to 0.15%;
Cu: 0% to 1.0%;
Ni: 0% to 1.0%;
Ca: 0% to 0.01%;
Mg: 0% to 0.01%;
REM: 0% to 0.01%;
Zr: 0% to 0.01%;
B: 0% to 0.005%;
Bi: 0% to 0.01%; and
balance: Fe and impurities,
wherein 70% or more of all Ti in steel precipitates.

(7)

The steel sheet for hot pressing according to (6), wherein the chemical composition contains one or more selected from the group consisting of, in mass %:
Nb: 0.003% to 0.20%;
V: 0.003% to 0.20%;
Cr: 0.005% to 1.0%;
Mo: 0.005% to 0.15%;
Cu: 0.005% to 1.0%; and
Ni: 0.005% to 1.0%.

(8)

The steel sheet for hot pressing according to (6) or (7), wherein the chemical composition contains one or more selected from the group consisting of, in mass %:
Ca: 0.0003% to 0.01%;
Mg: 0.0003% to 0.01%;
REM: 0.0003% to 0.01%; and
Zr: 0.0003% to 0.01%.

(9)

The steel sheet for hot pressing according to any one of (6) to (8), wherein the chemical composition contains, in mass %, B: 0.0003% to 0.005%.

(10)

The steel sheet for hot pressing according to any one of (6) to (9), wherein the chemical composition contains, in mass %, Bi: 0.0003% to 0.01%.

(11)

A method of manufacturing a hot-pressed steel sheet member, including:
heating the steel sheet for hot pressing according to any one of (6) to (10) in a temperature zone of an $Ac_3$ temperature to the $Ac_3$ temperature+100° C. for 1 minute to 10 minutes; and
hot pressing after the heating,
wherein the hot pressing includes:
first cooling in a temperature zone of 600° C. to 750° C.; and
second cooling in a temperature zone of 150° C. to 600° C.,
wherein an average cooling rate is 3° C./second to 200° C./second so as to cause ferrite to start to precipitate in the temperature zone of 600° C. to 750° C. in the first cooling, and
wherein the average cooling rate is 10° C./second to 500° C./second in the second cooling.

Advantageous Effects of Invention

According to the present invention, it is possible to obtain excellent ductility while obtaining high tensile strength without performing complicated control.

BRIEF DESCRIPTION OF DRAWINGS

FIG. 1 is a view illustrating a metal microstructure photograph of a hot-pressed steel sheet member according to an embodiment.

DESCRIPTION OF EMBODIMENTS

Hereinafter, embodiments of the present invention will be described. The embodiments of the present invention relate to a hot-pressed steel sheet member having a tensile strength of 980 MPa or more.

First, chemical compositions of the hot-pressed steel sheet member (hereinafter, sometimes referred to as a "steel sheet member") according to the embodiment of the present invention and a steel sheet for hot pressing used for manufacturing the same will be described. In the following description, "%" being a unit of content of each element contained in the steel sheet member or the steel sheet for hot pressing means "mass %" unless otherwise specified.

The chemical compositions of the steel sheet member according to the embodiment and the steel sheet for hot pressing used for manufacturing the same are represented by, in mass %: C: 0.10% to 0.24%; Si: 0.001% to 2.0%; Mn: 1.2% to 2.3%; sol. Al: 0.001% to 1.0%; Ti: 0.060% to 0.20%; P: 0.05% or less; S: 0.01% or less; N: 0.01% or less; Nb: 0% to 0.20%; V: 0% to 0.20%; Cr: 0% to 1.0%; Mo: 0% to 0.15%; Cu: 0% to 1.0%; Ni: 0% to 1.0%; Ca: 0% to 0.01%; Mg: 0% to 0.01%; REM: 0% to 0.01%; Zr: 0% to 0.01%; B: 0% to 0.005%; Bi: 0% to 0.01%; and balance: Fe and impurities. Examples of the impurities include ones contained in raw materials such as ore and scrap, and ones mixed in during a manufacturing process.

(C: 0.10% to 0.24%)

C is a very important element which increases hardenability of the steel sheet for hot pressing and mainly determines the strength of the steel sheet member. When the C content of the steel sheet member is less than 0.10%, it may be difficult to secure the tensile strength of 980 MPa or more. Accordingly, the C content is 0.10% or more. When the C content of the steel sheet for hot pressing is more than 0.24%, a steel microstructure of the steel sheet member may become a martensitic single phase, and there is remarkable deterioration in ductility. Accordingly, the C content is 0.24% or less. The C content of the steel sheet member is preferably 0.21% or less, and more preferably 0.18% or less from the viewpoint of weldability.

(Si: 0.001% to 2.0%)

Si is an element effective in improving the strength and ductility of the steel sheet member. When the Si content is less than 0.001%, it may be difficult to obtain the above-described effects. Accordingly, the Si content is 0.001% or more. When the Si content is more than 2.0%, the above-described effects may be saturated to result in economical disadvantage, and plating wettability significantly decreases to frequently cause unplating. Accordingly, the Si content is 2.0% or less. From the viewpoint of further improving the ductility, the Si content is preferably 0.05% or more. From the viewpoint of improving the weldability, the Si content is preferably 0.2% or more. From the viewpoint of relatively lowering a temperature at which the steel microstructure becomes an austenite single phase during hot pressing, the Si content is preferably 0.6% or less. When the temperature is the relatively low temperature, effects such as reduction in heating time, improvement in productivity, decrease in manufacturing cost, and suppression of damage to a heating furnace can be obtained.

(Mn: 1.2% to 2.3%)

Mn is an element very effective in improving the hardenability of the steel sheet for hot pressing and in securing the strength of the steel sheet member. When the Mn content is less than 1.2%, it may be difficult to obtain the above-described effects. Accordingly, the Mn content is 1.2% or more. When the Mn content is more than 2.3%, the steel microstructure of the steel sheet member may become a martensitic single phase, and there is remarkable deterioration in ductility. Accordingly, the Mn content is 2.3% or less. From the viewpoint of relatively lowering a temperature (for example, 860° C. or lower) at which the steel microstructure becomes an austenite single phase during hot pressing, the Mn content is preferably 1.4% or more. From the viewpoint of preventing the steel microstructure of the steel sheet member from becoming a conspicuous banded microstructure to thereby obtain excellent bendability, the Mn content is preferably 2.2% or less, and more preferably 2.1% or less.

(Sol. Al (Acid-Soluble Al): 0.001% to 1.0%)

Al is an element having an effect of deoxidizing steel to make steel material better. Al also has an effect of improving the yield of a carbonitride forming element such as Ti or the like. When the sol. Al content is less than 0.001%, it may be difficult to obtain the above-described effects. Accordingly, the sol. Al content is 0.001% or more. In order to more surely obtain the above-described effects, the sol. Al content is preferably 0.015% or more. When the sol. Al content is more than 1.0%, the weldability significantly may decrease, oxide-based inclusions may increase, and the surface property may significantly deteriorate. Accordingly, the sol. Al content is 1.0% or less. In order to obtain better surface property, the sol. Al content is preferably 0.080% or less.

(Ti: 0.060% to 0.20%)

Ti is an element accelerating ferrite transformation during hot pressing. The acceleration of the ferrite transformation significantly improves the ductility of the steel sheet member. Further, Ti finely precipitates as a carbide, a nitride or a carbonitride to make the steel microstructure of the steel sheet member finer. When the Ti content is less than 0.060%, the ferrite transformation is not sufficiently accelerated, and the steel microstructure of the steel sheet member is likely to become a martensitic single phase, failing to obtain sufficient ductility. Accordingly, the Ti content is 0.060% or more. From the viewpoint of further improving the ductility, the Ti content is preferably 0.075% or more. When the Ti content is more than 0.20%, a coarse carbonitride may be formed during casting and during hot-rolling for obtaining the steel sheet for hot pressing, and there is remarkable deterioration in toughness. Accordingly, the Ti content is 0.20% or less. From the viewpoint of securing excellent toughness, the Ti content is preferably 0.18% or less, and more preferably 0.15% or less.

(P: 0.05% or Less)

P is not an essential element and is contained, for example, as an impurity in steel. From the viewpoint of weldability, a lower P content is better. In particular, when the P content is more than 0.05%, the weldability may significantly decrease. Accordingly, the P content is 0.05% or less. In order to secure better weldability, the P content is preferably 0.018% or less. On the other hand, P has an effect of enhancing the strength of the steel by solid solution strengthening. To obtain the effect, 0.003% or more of P may be contained.

(S: 0.01% or Less)

S is not an essential element and is contained, for example, as an impurity in steel. From the viewpoint of the weldability, a lower S content is better. In particular, when the S content is more than 0.01%, the weldability may significantly decrease. Accordingly, the S content is 0.01% or less. In order to secure better weldability, the S content is preferably 0.003% or less, and more preferably 0.0015% or less.

(N: 0.01% or Less)

N is not an essential element and is contained, for example, as an impurity in steel. From the viewpoint of the weldability, a lower N content is better. In particular, when the N content is more than 0.01%, the weldability may significantly decrease. Accordingly, the N content is 0.01% or less. Tn order to secure better weldability, the N content is preferably 0.006% or less.

Nb, V, Cr, Mo, Cu, Ni, Ca, Mg, REM, Zr, B and Bi are not essential elements, and are arbitrary elements which may be appropriately contained, up to a specific amount as a limit, in the steel sheet member and the steel sheet for hot pressing.

(Nb: 0% to 0.20%, V: 0% to 0.20%, Cr: 0% to 1.0%, Mo: 0% to 0.15%, Cu: 0% to 1.0%, Ni: 0% to 1.0%)

Each of Nb, V, Cr, Mo, Cu, and Ni is an element which increases hardenability of the steel sheet for hot pressing and has an effect in stably securing the strength of the steel sheet member. Accordingly, one or more selected from the group consisting of these elements may be contained. However, regarding Nb and V, when any of their contents is more than 0.20%, not only hot-rolling and cold-rolling for obtaining the steel sheet for hot pressing may become difficult, but also the steel microstructure of the steel sheet member may become a martensitic single phase, and there is remarkable deterioration in ductility. Accordingly, each of the Nb content and the V content is 0.20% or less. Regarding Cr, when its content is more than 1.0%, it may become difficult to stably secure strength. Accordingly, the Cr content is 1.0% or less. Regarding Mo, when its content is more than 0.15%, the steel microstructure of the steel sheet member may become a martensitic single phase, and there is remarkable deterioration in ductility. Accordingly, the Mo content is 0.15% or less. Regarding Cu and Ni, any of their contents is 1.0%, the above-described effects may be saturated to result in economical disadvantage, and hot-rolling and cold-rolling for obtaining the steel sheet for hot pressing become difficult. Accordingly, each of the Cu content and the Ni content is 1.0% or less. In order to stably secure the strength of the steel sheet member, each of the Nb content and the V content is preferably 0.003% or more, and each of the Cr content, the Mo content, the Cu content, and the Ni content is preferably 0.005% or more. More specifically, it is preferable to satisfy at least one of "Nb: 0.003% to 0.20%", "V: 0.003% to 0.20%", "Cr: 0.005% to 1.0%", "Mo: 0.005% to 0.15%", "Cu: 0.005% to 1.0%", and "Ni: 0.005% to 1.0%".

(Ca: 0% to 0.01%, Mg: 0% to 0.01%, REM: 0% to 0.01%, Zr: 0% to 0.01%)

Each of Ca, Mg, REM, and Zr is an element which has an effect of contributing to control of inclusions, in particular, fine dispersion of inclusions to enhance the toughness. Accordingly, one or more selected from the group consisting of these elements may be contained. However, when the content of any one of them is more than 0.01%, the deterioration in surface property may become obvious. Accordingly, each of the Ca content, the Mg content, the REM content, and the Zr content is 0.01% or less. In order to improve the toughness, each of the Ca content, the Mg content, the REM content, and the Zr content is preferably 0.0003% or more. More specifically, it is preferable to satisfy at least one of "Ca: 0.0003% to 0.01%", "Mg: 0.0003% to 0.01%", "REM: 0.0003% to 0.01%", and "Zr: 0.0003% to 0.01%".

REM (rare-earth metal) indicates 17 kinds of elements in total of Sc, Y, and lanthanoid, and the "REM content" means a total content of these 17 kinds of elements. Lanthanoid is industrially added as a form of, for example, misch metal.

(B: 0% to 0.005%)

B is an element which has an effect of enhancing the toughness of the steel sheet. Accordingly, B may be contained. However, when the B content is more than 0.005%, the steel microstructure of the steel sheet member may become a martensitic single phase, and there is remarkable deterioration in ductility. Further, hot workability deteriorates, and hot-rolling for obtaining the steel sheet for hot pressing may become difficult. Accordingly, the B content is 0.005% or less. In order to enhance the toughness, the B content is preferably 0.0003% or more. More specifically, the B content is preferably 0.0003% to 0.005%.

(Bi: 0% to 0.01%)

Bi is an element which has an effect of uniforming the steel microstructure to enhance the ductility. Accordingly, Bi may be contained. However, when the Bi content is more than 0.01%, the hot workability deteriorates, and hot-rolling for obtaining the steel sheet for hot pressing may become difficult. Accordingly, the Bi content is 0.01% or less. In order to enhance the ductility, the Bi content is preferably 0.0003% or more. More specifically, the Bi content is preferably 0.0003% to 0.01%.

Next, the steel microstructure of the steel sheet member according to the embodiment and precipitates in the steel sheet member will be described. The steel sheet member includes a steel microstructure represented by, in area %: ferrite: 10% to 70%; martensite: 30% to 90%; and a total area ratio of ferrite and martensite: 90% to 100%. Further, 90% or more of all Ti in steel precipitates. Each of numerical values relating to the steel microstructure is, for example, an average value of the whole of the steel sheet member in a thickness direction, but the average value may be represented by a numerical value relating to the steel microstructure at a point where the depth from a surface of the steel sheet member is ¼ of the thickness of the steel sheet member (hereinafter, this point is sometimes referred to as a "¼ depth position"). For example, when the thickness of the steel sheet member is 2.0 mm, the average value may be represented by a numerical value at a point where the depth from the surface is 0.50 mm. This is because the steel microstructure at the ¼ depth position indicates an average steel microstructure in the thickness direction of the steel sheet member.

(Area Ratio of Ferrite: 10% to 70%)

The ferrite precipitated in a network form contributes to improvement in ductility of the steel sheet member. When the area ratio of ferrite is less than 10%, the ferrite is less likely to constitute the network, and sufficient ductility may not be obtained. Accordingly, the area ratio of ferrite is 10% or more. When the area ratio of ferrite is more than 70%, the area ratio of martensite necessarily becomes less than 30%, and it may be difficult to secure the tensile strength of 980 MPa or more in the steel sheet member. Accordingly, the area ratio of ferrite is 70% or less.

(Area Ratio of Martensite: 30% to 90%)

The martensite is important in increasing the strength of the steel sheet member. When the area ratio of martensite is less than 30%, it may be difficult to secure the tensile strength of 980 MPa or more in the steel sheet member. Accordingly, the area ratio of martensite is 30% or more. When the area ratio of martensite is more than 90%, the area ratio of ferrite necessarily becomes less than 10%, and sufficient ductility may not be obtained. Accordingly, the area ratio of martensite is 90% or less.

(Total Area Ratio of Ferrite and Martensite: 90% to 100%)

The steel microstructure of the hot-pressed steel sheet member according to the embodiment is preferably composed of ferrite and martensite, namely, the total area ratio of ferrite and martensite is preferably 100%. However, depending on the manufacturing conditions, one or more selected from the group consisting of bainite, retained austenite, cementite, and pearlite may be contained as a phase or microstructure other than ferrite and martensite. In this case, when the area ratio of the phase or microstructure other than ferrite and martensite is more than 10%, target properties may not be obtained in some cases due to the influence of the phase or microstructure. Accordingly, the area ratio of the phase or microstructure other than ferrite and martensite is 10% or less. That is, the total area ratio of ferrite and martensite is 90% or more.

As a method of measuring the area ratio of each phase in the above steel microstructure, a method well-known to the skilled person in the art may be employed. Each of the area ratios is obtained, for example, as an average value of a value measured in a cross section perpendicular to a rolling direction and a value measured in a cross section perpendicular to a sheet width direction (a direction perpendicular to the rolling direction). In other words, the area ratio is obtained, for example, as an average value of area ratios measured in two cross sections.

(Percentage of Precipitated Ti: 90% or More)

The precipitate of Ti contributes to stable securement of the tensile strength of the steel sheet member. As described above, the steel sheet member contains 0.060% to 0.20% of Ti, and when the percentage of precipitated Ti is less than 90%, it may be difficult to obtain the above-described effects. Accordingly, the percentage of the precipitated Ti of all Ti in steel is 90% or more in the steel sheet member. The precipitate of Ti is contained, for example, as a carbide, a nitride or a carbonitride, in the steel sheet member. The amount of Ti precipitated in the steel sheet member can be specified by inductively coupled plasma (ICP) analysis of residue obtained by electroextraction of the steel sheet member.

The steel sheet member can be manufactured by treating a specific steel sheet for hot pressing under specific conditions.

Here, the steel sheet for hot pressing used for manufacturing the steel sheet member according to the embodiment will be described. In the steel sheet for hot pressing, 70% or more of all Ti in steel precipitates.

The steel microstructure of the steel sheet for hot pressing is not particularly limited. This is because the steel sheet for hot pressing is heated up to a temperature of an $Ac_3$ temperature or higher during hot pressing as will be described later.

(Percentage of Precipitated Ti: 70% or More)

When the percentage of precipitated Ti of all Ti contained in the steel sheet for hot pressing is less than 70%, the ferrite transformation is less likely to occur during hot pressing, and it may be difficult to obtain the steel sheet member having a desired steel microstructure. Accordingly, in the steel sheet for hot pressing, the percentage of precipitated Ti of all Ti in steel is 70% or more.

Next, a method of manufacturing the steel sheet member according to the embodiment, namely, a method of treating the steel sheet for hot pressing will be described. In the treatment of the steel sheet for hot pressing, the steel sheet for hot pressing is heated in a temperature zone of the $Ac_3$ temperature to the $Ac_3$ temperature+100° C. for 1 minute to 10 minutes, and is subjected to hot pressing after the heating. In the hot pressing, first cooling is performed in a temperature zone of 600° C. to 750° C., and second cooling is performed in a temperature zone of 150° C. to 600° C. In the first cooling, an average cooling rate is 3° C./second to 200° C./second to cause ferrite to start to precipitate in the temperature zone of 600° C. to 750° C. In the second cooling, the average cooling rate is 10° C./second to 500° C./second.

(Heating Temperature of the Steel Sheet for Hot Pressing: A Temperature Zone of $Ac_3$ Temperature to $Ac_3$ Temperature+100° C.)

The steel sheet to be supplied to hot pressing, namely, the steel sheet for hot pressing is heated in a temperature zone of the $Ac_3$ temperature to the $Ac_3$ temperature+100° C. The $Ac_3$ temperature is a temperature (unit: ° C.) at which the steel microstructure becomes an austenite single phase, which is calculated by the following empirical formula (i).

$$Ac_3 = 910 - 203 \times (C^{0.5}) - 15.2 \times \mathrm{Ni} + 44.7 \times \mathrm{Si} + 104 \times V + 31.5 \times \mathrm{Mo} - 30 \times \mathrm{Mn} - 11 \times \mathrm{Cr} - 20 \times \mathrm{Cu} + 700 \times \mathrm{P} + 400 \times \mathrm{Al} + 50 \times \mathrm{Ti} \quad \text{(i)}$$

Here, the element symbol in the above formula indicates the content (unit: mass %) of each element in a chemical composition of the steel sheet.

When the heating temperature is lower than the $Ac_3$ temperature, the steel microstructure of the steel sheet member is likely to become non-uniform, and the steel sheet member is not stable in tensile strength and may deteriorate in ductility. Accordingly, the heating temperature is the $Ac_3$ temperature or higher. When the heating temperature is higher than the $Ac_3$ temperature+100° C., the stability of an austenite grain boundary excessively increases and the ferrite transformation becomes less likely to be accelerated. As a result, the steel microstructure of the steel sheet member becomes a martensitic single phase, and the ductility significantly deteriorates. Further, when the Ti content is less than 0.08%, the precipitate of Ti becomes likely to dissolve. Accordingly, the heating temperature is the $Ac_3$ temperature+100° C. or lower. From the viewpoint of suppressing damage to a heating furnace and improving the productivity, the heating temperature is preferably 860° C. or lower. Appropriately controlling the composition of the steel sheet for hot pressing makes it possible to make the steel microstructure into an austenite single phase at a temperature of 860° C. or lower.

(Heating Time of the Steel Sheet for Hot Pressing: 1 Minute to 10 Minutes)

When the heating time is less than 1 minute, the single phase microstructure of austenite is likely to be non-uniform, and it may be difficult to stably secure strength. Accordingly, the heating time is 1 minute or more. When the heating time is more than 10 minutes, the ferrite transformation is less likely to occur during cooling thereafter, and the steel microstructure of the steel sheet member may become a martensitic single phase and significantly deteriorate in ductility. Further, the decrease in productivity may become remarkable. Accordingly, the heating time is 10 minutes or less.

The heating time is a time period from the time at which the temperature of the steel sheet reaches the $Ac_3$ temperature to a heating end time. The heating end time, specifically, is the time at which the steel sheet is taken out of the heating furnace in the case of furnace heating, and is the time at which induction or the like is turned off in the case of electric resistance heating or induction heating.

An average heating rate in the heating up to the temperature zone of the $Ac_3$ temperature to the $Ac_3$ temperature+100° C. is preferably 0.2° C./second to 100 o/sc on d. Setting the average heating rate to 0.2° C./second or more makes it possible to secure higher productivity. Further, setting the average heating rate to 100° C./second or less makes it easy to control the heating temperature when it is heated by using an ordinary furnace. In the case of performing high-frequency heating or electric resistance heating, even when the average heating rate is more than 100° C./second, the control of the heating temperature is easy, so that the average heating rate may be more than 100° C./second. The average heating rate in a temperature zone of 700° C. to the $Ac_3$ temperature is preferably 1° C./second to 10° C./second. When the average heating rate in this temperature zone is within this range, the steel microstructure of the steel sheet member can be made further uniform and further improved in ductility.

(Ferrite Precipitation Start Temperature: 600° C. to 750° C.)

The precipitation start temperature of ferrite in hot pressing affects the quality of ferrite. When ferrite starts to precipitate over 750° C., the ferrite may become coarse and the toughness may be deteriorated. When ferrite starts to precipitate below 600° C., the dislocation density in ferrite may increase and the ductility may be deteriorated. Accordingly, in the first cooling, ferrite is caused to start to precipitate in a temperature zone of 600° C. to 750° C.

(Average Cooling Rate in the First Cooling: 3° C./Second to 200° C./Second)

A temperature at which ferrite is caused to start to precipitate, namely, a precipitation start temperature of ferrite can be controlled by adjusting the average cooling rate in hot pressing. For example, the first cooling is preferably performed under the conditions obtained by analysis of a thermal expansion curve. However, when the average cooling rate in the first cooling is less than 3° C./second even when the precipitation start temperature of ferrite is in the range of 600° C. to 750° C., the ferrite transformation excessively progresses, so that it is difficult to make the area ratio of martensite in the steel sheet member to 30% or more and a tensile strength of 980 MPa or more may not be obtained. It may be difficult to control the average cooling rate to less than 3° C./second only by air cooling or by forced air cooling. Accordingly, the average cooling rate in the first cooling is 3° C./second or more. This average cooling rate is preferably 6° C./second or more. Further, when the average cooling rate in the first cooling is more than 200° C./second even when the precipitation start temperature of ferrite is in the range of 600° C. to 750° C., it may be difficult to make the area ratio of ferrite in the steel sheet member to 10% or more and excellent ductility may not be obtained. Accordingly, the average cooling rate in the first cooling is 200° C./second or less. This average cooling rate is preferably 60° C./second or less.

In the case of using the steel sheet for hot pressing having the above-described chemical composition and 70% or more of the precipitated Ti of all Ti in steel, ferrite starts to precipitate in the temperature zone of 600° C. to 750° C. when the average cooling rate in the temperature zone of 600° C. to 750° C. is 3° C./second to 200° C./second.

(Average Cooling Rate in the Second Cooling: 10° C./Second to 500° C./Second)

It is important to make diffusional transformation unlikely to occur in the cooling in a temperature zone of 150° C. to 600° C. When the average cooling rate in this temperature zone is less than 10° C./second, bainite transformation being the diffusional transformation is likely to occur, so that it may be difficult to make the area ratio of martensite in the steel sheet member to 30% or more and it may be difficult to secure the tensile strength of 980 MPa or more. Accordingly, the average cooling rate in the second cooling is 10° C./second or more. From the viewpoint of more surely securing a higher area ratio of martensite, the average cooling rate is preferably 15° C./second or more. It may be difficult to make the average cooling rate in the second cooling to more than 500° C./second in an ordinary facility. Accordingly, the average cooling rate in the temperature zone is 500° C./second or less. From the viewpoint of more stable cooling, the average cooling rate is preferably 200° C./second or less.

Between the first cooling and the second cooling, a steel microstructure in which fine ferrite is distributed in a network form as illustrated in FIG. 1 is obtained. Such a steel microstructure is effective in improving the ductility.

In the second cooling, heat generation by phase transformation is likely to extremely increase after the temperature reaches 600° C. Therefore, when the cooling in the temperature zone of lower than 600° C. is performed by the same method as the cooling in the temperature zone of 600° C. or higher, it may be difficult to secure a sufficient average cooling rate in some cases. It is preferable to perform the second cooling from 600° C. to 150° C. more forcibly than the first cooling to 600° C. For example, it is preferable to employ the following method.

Generally, the cooling in the hot pressing is performed by setting a die made of steel used for forming a heated steel sheet to normal temperature or a temperature of about several tens of degrees centigrade in advance and bringing the steel sheet into contact with the die. Accordingly, the average cooling rate can be controlled, for example, by change in heat capacity with the change in size of the die. The average cooling rate can be also controlled by changing the material of the die to a different metal (for example, Cu or the like). The average cooling rate can be also controlled by using a water-cooling die and changing the amount of cooling water flowing through the die. The average cooling rate can be also controlled by forming a plurality of grooves in the die in advance and passing water through the grooves during hot pressing. The average cooling rate can be also controlled by raising a hot pressing machine in the middle of the hot pressing and passing water through its space. The average cooling rate can be also controlled by adjusting a die clearance and changing a contact area of the die with the steel sheet.

Examples of the method of increasing the cooling rate in the temperature zone of 600° C. or lower include the following three kinds.

(a) Immediately after reaching 600° C., the steel sheet is moved to a die different in heat capacity or a die at room temperature.

(b) A water-cooling die is used and the water flow rate through the die is increased immediately after reaching 600° C.

(c) Immediately after reaching 600° C., water is passed between the die and the steel sheet. In this method, the cooling rate may be further increased by increasing the quantity of water according to temperature.

The mode of the forming in the hot pressing in the embodiment is not particularly limited. Examples of the mode of the forming include bending, drawing, bulging, hole expansion, and flanging. The mode of the forming may be appropriately selected depending on the kind of a target steel sheet member. Representative examples of the steel sheet member include a door guard bar, a bumper reinforcement and the like which are automobile reinforcing components. The hot forming is not limited to the hot pressing as long as the steel sheet can be cooled simultaneously with forming or immediately after forming. For example, roll forming may be performed as the hot forming.

Such a series of treatments are performed on the above-described steel sheet for hot pressing, namely, a steel sheet for hot pressing having specific contents of C, Mn and Ti, whereby the steel sheet member according to the embodiment can be manufactured. In other words, it is possible to obtain a hot-pressed steel sheet member having a desired steel microstructure, a tensile strength of 980 MPa, and excellent strength and ductility, without performing complicated control.

For example, the ductility can be evaluated by a total elongation (EL) in a tensile test, and the total elongation in the tensile test is preferably 10% or more in the embodiment. The total elongation is more preferably 14% or more.

After the hot pressing and cooling, shot blasting may be performed. By the shot blasting, scale can be removed. The shot blasting also has an effect of introducing a compressive stress into the surface of the steel sheet member, and therefore effects of suppressing delayed fracture and improving fatigue strength can also be obtained.

In the above-described method of manufacturing the steel sheet member, the steel sheet for hot pressing is heated in the temperature zone of the $Ac_3$ temperature to the $Ac_3$ temperature+100° C. to cause austenite transformation, and then is formed. Accordingly, the mechanical properties of the steel sheet for hot pressing at room temperature before heating are not important. Therefore, as the steel sheet for hot pressing, for example, a hot-rolled steel sheet, a cold-rolled steel sheet, a plated steel sheet and the like may be used. Examples of the cold-rolled steel sheet include a full hard material and an annealed material. Examples of the plated steel sheet include an aluminum plated steel sheet and a zinc plated steel sheet. Their manufacturing methods are not particularly limited.

The steel sheet member according to the embodiment can also be manufactured through hot pressing accompanied by performing. For example, in a range where the above-described conditions of the heating and the cooling are satisfied, the hot-pressed steel sheet member may be manufactured by preforming by press working of the steel sheet for hot pressing using a die in a specific shape, putting it into the same type of die, applying a pressing force thereto, and rapidly cooling it. Also in this case, the kind of the steel sheet for hot pressing and its steel microstructure are not limited, but it is preferable to use a steel sheet that is soft and has ductility as much as possible in order to facilitate the preforming. For example, the tensile strength is preferably 700 MPa or less. A coiling temperature after the hot-rolling of the hot-rolled steel sheet is preferably 450° C. or higher in order to obtain a soft steel sheet, and is preferably 700° C. or lower in order to reduce scale loss. In the cold-rolled steel sheet, annealing is preferable to obtain a soft steel sheet, and the annealing temperature is preferably the $Ac_1$ temperature to 900° C. The average cooling rate down to room temperature after annealing is preferably an upper critical cooling rate or lower.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

EXAMPLE

Next, the experiment performed by the inventors of the present application will be described. In this experiment, first, 23 kinds of steel materials having chemical compositions listed in Table 1 were used to fabricate 30 kinds of sample materials each having a thickness of 1.2 mm listed in Table 2. The balance of each steel material was Fe and impurities.

In fabrication of each of the sample materials, a slab prepared in a laboratory was hot-rolled and cold-rolled. In fabrication of Sample Material No. 1, a cold-rolled steel sheet obtained by cold-rolling was subjected to Al plating of a coating weight per side of 120 g/m$^2$. In fabrication of Sample Material No. 2, a cold-rolled steel sheet obtained by cold-rolling was subjected to hot-dip galvanizing of a coating weight per side of 60 g/m$^2$, and then subjected to alloying treatment. An Fe content in a hot-dip galvanized film became 15 mass % by the alloying treatment. The Al plating and the hot-dip galvanizing were performed by using a plating simulator, and an annealing temperature in the plating simulator was 820° C., and the average cooling rate from 820° C. to 500° C. was 5° C./second.

After the fabrication of each sample material, a steel piece having a thickness of 1.2 mm, a width of 100 mm, and a length of 200 mm was cut out of each sample material, and heat-treated (heating and cooling) under the conditions listed in Table 2. In the thermal treatment, while a thermocouple was attached to the steel piece, the average cooling rate in the first cooling and the average cooling rate in the second cooling were measured. Further, the precipitation start temperature of ferrite was obtained from the analysis result of the dilatometry curve.

TABLE 1

| STEEL MATERIAL | CHEMICAL COMPOSITION (MASS %) | | | | | | | | | | | | | |
|---|---|---|---|---|---|---|---|---|---|---|---|---|---|---|
| SYMBOL | C | Si | Mn | P | S | sol. Al | N | Ti | Nb | V | Cr | Mo | Cu | Ni |
| A | 0.14 | 0.05 | 1.82 | 0.012 | 0.0014 | 0.027 | 0.0043 | 0.129 | — | — | — | — | — | — |
| B | 0.15 | 0.06 | 1.57 | 0.009 | 0.0012 | 0.034 | 0.0041 | 0.102 | — | — | — | — | — | — |
| C | 0.17 | 0.02 | 1.88 | 0.014 | 0.0019 | 0.030 | 0.0046 | 0.062 | — | 0.205 | — | — | — | — |
| D | 0.17 | 0.07 | 1.53 | 0.012 | 0.0014 | 0.028 | 0.0049 | 0.114 | — | — | — | — | — | — |
| E | 0.09 | 0.06 | 1.52 | 0.012 | 0.0018 | 0.034 | 0.0037 | 0.104 | — | — | — | — | — | — |
| F | 0.12 | 0.08 | 1.75 | 0.011 | 0.0019 | 0.025 | 0.0040 | 0.105 | — | — | — | 0.10 | — | — |
| G | 0.15 | 0.07 | 1.97 | 0.014 | 0.0016 | 0.023 | 0.0041 | 0.089 | — | — | — | — | — | — |
| H | 0.17 | 0.07 | 1.64 | 0.013 | 0.0009 | 0.028 | 0.0047 | 0.012 | — | — | — | — | — | — |
| I | 0.15 | 0.34 | 1.65 | 0.014 | 0.0016 | 0.023 | 0.0039 | 0.089 | 0.021 | — | — | — | — | — |
| J | 0.14 | 0.05 | 1.62 | 0.012 | 0.0011 | 0.021 | 0.0044 | 0.077 | 0.043 | — | — | — | — | — |
| K | 0.20 | 0.06 | 1.47 | 0.013 | 0.0012 | 0.032 | 0.0041 | 0.065 | — | — | — | 0.20 | — | — |
| L | 0.11 | 1.20 | 1.59 | 0.014 | 0.0013 | 0.029 | 0.0045 | 0.112 | — | — | — | — | — | — |
| M | 0.15 | 0.08 | 2.42 | 0.016 | 0.0015 | 0.031 | 0.0047 | 0.104 | — | — | — | — | — | — |
| N | 0.15 | 0.40 | 1.64 | 0.011 | 0.0016 | 0.036 | 0.0042 | 0.098 | — | — | — | — | — | — |
| O | 0.26 | 0.06 | 1.79 | 0.013 | 0.0017 | 0.035 | 0.0036 | 0.086 | — | — | — | — | — | — |
| P | 0.21 | 0.06 | 1.41 | 0.011 | 0.0015 | 0.034 | 0.0045 | 0.112 | — | — | 0.10 | — | — | — |
| Q | 0.18 | 0.04 | 1.65 | 0.016 | 0.0017 | 0.035 | 0.0043 | 0.086 | — | — | — | — | — | — |
| R | 0.16 | 0.24 | 1.62 | 0.015 | 0.0014 | 0.031 | 0.0047 | 0.112 | — | — | — | — | — | — |
| S | 0.14 | 0.07 | 1.04 | 0.008 | 0.0016 | 0.028 | 0.0042 | 0.085 | — | — | — | — | — | — |
| T | 0.15 | 0.02 | 1.62 | 0.016 | 0.0012 | 0.029 | 0.0041 | 0.080 | 0.024 | 0.020 | — | — | — | — |
| U | 0.11 | 0.58 | 1.24 | 0.017 | 0.0015 | 0.065 | 0.0045 | 0.094 | — | — | — | — | 0.10 | 0.10 |
| V | 0.21 | 0.03 | 2.21 | 0.015 | 0.0017 | 0.031 | 0.0038 | 0.066 | 0.212 | — | — | — | — | — |
| W | 0.11 | 0.08 | 1.63 | 0.012 | 0.0013 | 0.032 | 0.0036 | 0.063 | — | — | — | — | — | — |

TABLE 1-continued

| STEEL MATERIAL SYMBOL | CHEMICAL COMPOSITION (MASS %) Ca | Mg | REM | Zr | B | Bi | Ac3 (° C.) |
|---|---|---|---|---|---|---|---|
| A | — | — | — | — | — | — | 807 |
| B | — | — | — | — | — | — | 812 |
| C | — | — | — | — | 0.0015 | — | 817 |
| D | — | — | — | — | — | — | 809 |
| E | — | — | — | — | — | — | 833 |
| F | — | — | — | — | — | — | 817 |
| G | — | — | — | — | — | — | 799 |
| H | — | — | — | — | — | — | 801 |
| I | — | — | — | — | — | 0.0040 | 821 |
| J | 0.001 | 0.002 | — | — | — | — | 808 |
| K | — | — | — | — | 0.0028 | — | 809 |
| L | — | — | — | — | — | — | 876 |
| M | — | — | — | — | — | — | 791 |
| N | — | — | — | — | — | — | 827 |
| O | — | — | — | — | — | — | 783 |
| P | — | — | — | — | — | — | 803 |
| Q | — | — | — | — | 0.0062 | — | 806 |
| R | — | — | — | — | 0.0008 | — | 819 |
| S | — | — | — | — | — | — | 827 |
| T | — | — | — | — | — | — | 813 |
| U | — | — | 0.003 | 0.002 | — | — | 870 |
| V | — | — | — | — | 0.0032 | — | 778 |
| W | — | — | — | — | — | — | 822 |

UNDERLINE INDICATES THAT VALUE IS OUTSIDE THE RANGE OF THE PRESENT INVENTION

TABLE 2

| SAMPLE MATERIAL No. | STEEL MATERIAL SYMBOL | STEEL PIECE TYPE | PRECIPITATION RATIO OF Ti (%) | HEATING CONDITIONS HEATING RATE (° C./SEC) | HEATING TEMPERATURE (° C.) | HEATING TIME (MN) | COOLING CONDITIONS AVERAGE COOLING RATE IN FIRST COOLING (° C./SEC) | PRECIPITATION START TEMPERATURE OF FERRITE (° C.) | AVERAGE COOLING RATE IN SECOND COOLING (° C./SEC) |
|---|---|---|---|---|---|---|---|---|---|
| 1 | A | ALUMINUM PLATED STEEL SHEET | 79 | 8 | 850 | 4 | 20 | 730 | 80 |
| 2 | A | HOT-DIP GALVANIZED STEEL SHEET | 79 | 8 | 850 | 4 | 2 | 735 | 80 |
| 3 | A | FULL HARD | 79 | 8 | 850 | 4 | 22 | 728 | 5 |
| 4 | B | FULL HARD | 74 | 8 | 850 | 4 | 25 | 732 | 80 |
| 5 | C | FULL HARD | 77 | 8 | 850 | 4 | 25 | NOT PRECIPITATED | 80 |
| 6 | D | FULL HARD | 73 | 8 | 850 | 4 | 20 | 739 | 80 |
| 7 | E | FULL HARD | 76 | 8 | 850 | 4 | 20 | 745 | 80 |
| 8 | F | FULL HARD | 78 | 8 | 850 | 4 | 20 | 742 | 80 |
| 9 | F | FULL HARD | 78 | 8 | 850 | 30 | 25 | NOT PRECIPITATED | 80 |
| 10 | F | FULL HARD | 78 | 8 | 850 | 4 | 250 | NOT SPECIFIED | 250 |
| 11 | G | FULL HARD | 75 | 8 | 850 | 4 | 30 | 721 | 80 |
| 12 | G | FULL HARD | 75 | 8 | 1000 | 4 | 35 | NOT PRECIPITATED | 80 |
| 13 | G | FULL HARD | 64 | 8 | 850 | 4 | 30 | NOT PRECIPITATED | 80 |
| 14 | H | FULL HARD | 74 | 8 | 850 | 4 | 25 | NOT PRECIPITATED | 80 |
| 15 | I | FULL HARD | 78 | 8 | 850 | 4 | 20 | 746 | 80 |
| 16 | J | FULL HARD | 83 | 8 | 850 | 4 | 25 | 729 | 80 |
| 17 | K | FULL HARD | 79 | 8 | 850 | 4 | 20 | NOT PRECIPITATED | 80 |
| 18 | L | FULL HARD | 73 | 8 | 890 | 4 | 60 | 746 | 80 |
| 19 | M | FULL HARD | 76 | 8 | 850 | 4 | 20 | NOT PRECIPITATED | 80 |
| 20 | N | FULL HARD | 73 | 8 | 850 | 4 | 20 | 741 | 80 |
| 21 | O | FULL HARD | 75 | 8 | 850 | 4 | 25 | NOT PRECIPITATED | 80 |
| 22 | P | FULL HARD | 78 | 8 | 850 | 4 | 15 | 726 | 80 |
| 23 | Q | FULL HARD | 78 | 8 | 850 | 4 | 20 | NOT PRECIPITATED | 80 |

TABLE 2-continued

| SAMPLE MATERIAL No. | STEEL MATERIAL SYMBOL | STEEL PIECE TYPE | PRECIPITATION RATIO OF Ti (%) | HEATING CONDITIONS HEATING RATE (° C./SEC) | HEATING TEMPERATURE (° C.) | HEATING TIME (MN) | COOLING CONDITIONS AVERAGE COOLING RATE IN FIRST COOLING (° C./SEC) | PRECIPITATION START TEMPERATURE OF FERRITE (° C.) | AVERAGE COOLING RATE IN SECOND COOLING (° C./SEC) |
|---|---|---|---|---|---|---|---|---|---|
| 24 | R | FULL HARD | 75 | 8 | 850 | 4 | 20 | 740 | 80 |
| 25 | S | FULL HARD | 73 | 8 | 850 | 4 | 20 | 745 | 80 |
| 26 | T | FULL HARD | 82 | 8 | 850 | 4 | 25 | 733 | 80 |
| 27 | U | FULL HARD | 78 | 8 | 890 | 4 | 60 | 743 | 80 |
| 28 | V | FULL HARD | 76 | 8 | 850 | 4 | 25 | NOT PRECIPITATED | 80 |
| 29 | W | FULL HARD | 76 | 8 | 840 | 4 | 10 | 735 | 80 |
| 30 | W | FULL HARD | 76 | 8 | 1050 | 4 | 10 | 710 | 80 |

UNDERLINES INDICATES THAT VALUE IS OUTSIDE THE RANGE OF THE PRESENT INVENTION

After the thermal treatment, the tensile test and microstructural observation of the specimen were performed on each of the steel pieces. In the tensile test, the tensile strength (TS) and the total elongation (EL) were measured. In the measurement of the tensile strength and the total elongation, a JIS No. 5 tensile test piece obtained from each steel piece was used. In the microstructural observation of the specimen, the area ratio of ferrite and the area ratio of martensite were found. These area ratios are each an average value calculated by performing image analysis of electron micrograph observation images in two cross sections, that is, a cross section perpendicular to a rolling direction and a cross section perpendicular to a sheet width direction (a direction perpendicular to the rolling direction). The area of a field of view of the electron micrograph observation was 8 $mm^2$. These results are listed in Table 3. Hot pressing was not performed on the steel piece being the target of the tensile test and the microstructural observation of the specimen, but the mechanical properties of the steel piece reflect the mechanical properties of the hot-pressed steel sheet member fabricated receiving, during forming, the same thermal history as that of the thermal treatment of this experiment. In other words, as long as the thermal history is substantially the same, the mechanical properties thereafter become substantially the same regardless of presence or absence of hot pressing accompanied by forming.

TABLE 3

| SAMPLE MATERIAL No. | STEEL MICROSTRUCTURE FERRITE AREA RATIO (%) | MARTENSITE AREA RATIO (%) | TOTAL AREA RATIO OF FERRITE AND MARTENSITE (%) | PRECIPITATION RATIO OF Ti (%) | TS (MPa) | EL (%) | NOTE |
|---|---|---|---|---|---|---|---|
| 1 | 25 | 75 | 100 | 95 | 1075 | 12.1 | INVENTION EXAMPLE |
| 2 | 72 | 28 | 100 | 92 | 864 | 21.6 | COMPARATIVE EXAMPLE |
| 3 | 27 | 25 | 52 | 95 | 826 | 21.3 | COMPARATIVE EXAMPLE |
| 4 | 31 | 69 | 100 | 93 | 1032 | 13.5 | INVENTION EXAMPLE |
| 5 | 0 | 100 | 100 | 91 | 1395 | 5.3 | COMPARATIVE EXAMPLE |
| 6 | 26 | 74 | 100 | 94 | 1043 | 11.8 | INVENTION EXAMPLE |
| 7 | 45 | 55 | 100 | 96 | 945 | 14.2 | COMPARATIVE EXAMPLE |
| 8 | 18 | 82 | 100 | 93 | 1095 | 12.6 | INVENTION EXAMPLE |
| 9 | 0 | 100 | 100 | 92 | 1248 | 8.8 | COMPARATIVE EXAMPLE |
| 10 | 6 | 94 | 100 | 95 | 1202 | 7.9 | COMPARATIVE EXAMPLE |
| 11 | 16 | 84 | 100 | 94 | 1198 | 11.1 | INVENTION EXAMPLE |
| 12 | 0 | 100 | 100 | 91 | 1402 | 6.5 | COMPARATIVE EXAMPLE |
| 13 | 0 | 96 | 96 | 93 | 1345 | 6.8 | COMPARATIVE EXAMPLE |
| 14 | 0 | 100 | 100 | 96 | 1288 | 8.5 | COMPARATIVE EXAMPLE |
| 15 | 34 | 64 | 98 | 97 | 1046 | 15.3 | INVENTION EXAMPLE |
| 16 | 33 | 67 | 100 | 94 | 1013 | 12.1 | INVENTION EXAMPLE |
| 17 | 0 | 100 | 100 | 92 | 1521 | 5.3 | COMPARATIVE EXAMPLE |
| 18 | 25 | 71 | 96 | 95 | 1012 | 14.3 | INVENTION EXAMPLE |
| 19 | 0 | 100 | 100 | 91 | 1421 | 8.7 | COMPARATIVE EXAMPLE |
| 20 | 26 | 71 | 97 | 93 | 1092 | 14.5 | INVENTION EXAMPLE |
| 21 | 0 | 100 | 100 | 93 | 1594 | 4.5 | COMPARATIVE EXAMPLE |
| 22 | 18 | 82 | 100 | 96 | 1211 | 10.6 | INVENTION EXAMPLE |
| 23 | 0 | 100 | 100 | 94 | 1452 | 5.8 | COMPARATIVE EXAMPLE |
| 24 | 15 | 85 | 100 | 93 | 1195 | 10.9 | INVENTION EXAMPLE |
| 25 | 21 | 52 | 73 | 95 | 962 | 14.5 | COMPARATIVE EXAMPLE |
| 26 | 20 | 80 | 100 | 92 | 1056 | 11.9 | INVENTION EXAMPLE |
| 27 | 26 | 74 | 100 | 94 | 1056 | 12.9 | INVENTION EXAMPLE |
| 28 | 0 | 100 | 100 | 94 | 1465 | 8.9 | COMPARATIVE EXAMPLE |
| 29 | 44 | 56 | 100 | 93 | 1085 | 13.8 | INVENTION EXAMPLE |
| 30 | 42 | 58 | 100 | 83 | 963 | 14.2 | COMPARATIVE EXAMPLE |

UNDERLINE INDICATES THAT VALUE IS OUTSIDE THE RANGE OF THE PRESENT INVENTION

As listed in Table 3, Sample Materials No. 1, No. 4, No. 6, No. 8, No. 11, No. 15, No. 16, No. 18, No. 20. No. 22, No. 24, No. 26, No. 27, and No. 29 were invention examples each of which exhibited excellent tensile strength and ductility.

On the other hand, Sample Materials No. 2, No. 3, and No. 30 each failed to obtain sufficient tensile strength because the manufacturing conditions were outside the range of the present invention and the steel microstructure after the thermal treatment was also outside the range of the present invention. Sample Materials No. 5, No. 14, No. 17, No. 19, No. 21, No. 23, and No. 28 each failed to obtain sufficient ductility because the chemical composition of the steel material was outside the range of the present invention and the steel microstructure after the thermal treatment was also outside the range of the present invention. Sample Material No. 7 failed to obtain sufficient ductility because the chemical composition of the steel material was outside the range of the present invention. Sample Materials No. 9, No. 10, and No. 12 each failed to obtain sufficient ductility because the manufacturing conditions were outside the range of the present invention and the steel microstructure after the thermal treatment was also outside the range of the present invention. Sample Material No. 25 failed to obtain sufficient tensile strength because the chemical composition of the steel material was outside the range of the present invention and the steel microstructure after the thermal treatment was also outside the range of the present invention.

INDUSTRIAL APPLICABILITY

The present invention may be used for, for example, industries of manufacturing and using automobile body structural components and so on in which importance is placed on excellent tensile strength and ductility. The present invention may be used also for industries of manufacturing and using other machine structural components, and so on.

The invention claimed is:

1. A hot-pressed steel sheet member, comprising:

a chemical composition represented by, in mass %:

C: 0.10% to 0.24%;
Si: 0.001% to 2.0%;
Mn: 1.2% to 2.3%;
sol. Al: 0.001% to 1.0%;
Ti: 0.060% to 0.20%;
P: 0.05% or less;
S: 0.01% or less;
N: 0.01% or less;
Nb: 0% to 0.20%;
V: 0% to 0.20%;
Cr: 0% to 1.0%;
Mo: 0% to 0.15%;
Cu: 0% to 1.0%;
Ni: 0% to 1.0%;
Ca: 0% to 0.01%;
Mg: 0% to 0.01%;
REM: 0% to 0.01%;
Zr: 0% to 0.01%;
B: 0% to 0.005%;
Bi: 0% to 0.01%; and
balance: Fe and impurities; and a steel microstructure represented by, in area %:

ferrite: 10% to 70%;
martensite: 30% to 90%; and
a total area ratio of ferrite and martensite: 90% to 100%, wherein 90% or more of all Ti in steel precipitates, and wherein a tensile strength of the hot-pressed steel sheet member is 980 MPa or more.

2. The hot-pressed steel sheet member according to claim 1, wherein the chemical composition comprises one or more selected from the group consisting of, in mass %:

Nb: 0.003% to 0.20%;
V: 0.003% to 0.20%;
Cr: 0.005% to 1.0%;
Mo: 0.005% to 0.15%;
Cu: 0.005% to 1.0%; and
Ni: 0.005% to 1.0%.

3. The hot-pressed steel sheet member according to claim 1, wherein the chemical composition comprises one or more selected from the group consisting of, in mass %:

Ca: 0.0003% to 0.01%;
Mg: 0.0003% to 0.01%;
REM: 0.0003% to 0.01%; and
Zr: 0.0003% to 0.01%.

4. The hot-pressed steel sheet member according to claim 1, wherein the chemical composition comprises, in mass %, B: 0.0003% to 0.005%.

5. The hot-pressed steel sheet member according to claim 1, wherein the chemical composition comprises, in mass %, Bi: 0.0003% to 0.01%.

6. A method of manufacturing a hot-pressed steel sheet member, comprising:

heating a steel sheet for hot pressing in a temperature zone of an $Ac_3$ temperature to the $Ac_3$ temperature+100° C. for 1 minute to 10 minutes; and hot pressing after the heating, wherein the steel sheet for hot pressing, comprises:

a chemical composition represented by, in mass %:

C: 0.10% to 0.24%;
Si: 0.001% to 2.0%;
Mn: 1.2% to 2.3%;
sol. Al: 0.001% to 1.0%;
Ti: 0.060% to 0.20%;
P: 0.05% or less;
S: 0.01% or less;
N: 0.01% or less;
Nb: 0% to 0.20%;
V: 0% to 0.20%;
Cr: 0% to 1.0%;
Mo: 0% to 0.15%;
Cu: 0% to 1.0%;
Ni: 0% to 1.0%;
Ca: 0% to 0.01%;
Mg: 0% to 0.01%;
REM: 0% to 0.01%;
Zr: 0% to 0.01%;
B: 0% to 0.005%;
Bi: 0% to 0.01%; and
balance: Fe and impurities, wherein 70% or more of all Ti in steel precipitates, wherein the hot pressing comprises:

first cooling in a temperature zone of 600° C. to 750° C.; and second cooling in a temperature zone of 150° C. to 600° C., wherein an average cooling rate in the second cooling is larger than an average cooling rate in the first cooling, wherein the average cooling rate is 3° C./second to 200° C./second so as to cause ferrite to start to precipitate in the temperature zone of 600° C. to 750° C. in the first cooling, and wherein the average cooling rate is 10° C./second to 500° C./second in the second cooling.

* * * * *